United States Patent [19]

Bernatt et al.

[11] 4,047,142

[45] Sept. 6, 1977

[54] BREATHER ASSEMBLY FOR ELECTRICAL APPARATUS

[75] Inventors: Joseph Bernatt, Arlington Heights; John E. Guleserian, Prairie View, both of Ill.

[73] Assignee: S&C Electric Company, Chicago, Ill.

[21] Appl. No.: 741,023

[22] Filed: Nov. 11, 1976

[51] Int. Cl.[2] ..... H01H 85/20

[52] U.S. Cl. ..... 337/186; 337/248; 337/414

[58] Field of Search ..... 337/248, 249, 250, 203, 337/186, 414, 205; 174/16 R, 17 VA, 187

[56] References Cited

U.S. PATENT DOCUMENTS

| | | | |
|---|---|---|---|
| 1,874,948 | 8/1932 | Fogal | 337/250 |
| 1,880,379 | 10/1932 | Fogal | 337/250 |
| 2,135,164 | 11/1938 | Brock | 337/249 |
| 2,168,153 | 8/1939 | Brown | 337/250 X |
| 3,696,729 | 10/1972 | Chabala et al. | 174/16 R X |

*Primary Examiner*—George Harris
*Attorney, Agent, or Firm*—Kirkland & Ellis

[57] ABSTRACT

A breather assembly for permitting atmospheric venting to the interior of electrical apparatus such as a high voltage fuse while preventing moisture from entering the fuse comprises three separate chambers communicating in such a way that the atmosphere can be vented to the interior of the fuse but moisture is precluded from entering the interior of the fuse regardless of the orientation of the fuse body.

10 Claims, 3 Drawing Figures

BREATHER ASSEMBLY FOR ELECTRICAL APPARATUS

BACKGROUND OF THE INVENTION

1. Field of the Invention

The present invention relates to breather assemblies for electrical apparatus, and more particularly, to a breather assembly which permits venting to the atmosphere of the interior of a high voltage fuse to maintain equal pressure while precluding the admittance of moisture to the interior of the fuse.

2. Description of the Prior Art

High voltage fuses for interrupting current in high voltage circuits are well known in the art. For example, U.S. Pat. Nos. 3,267,235 - Barta, 3,575,683 - Fahnoe, 3,176,100 - Barta, and 3,855,563 - Cameron et al., illustrate typical fuses for high voltage electric power circuits. Such high voltage fuses are often mounted outside on utility poles, and thus are directly exposed to adverse weather conditions including rain, sleet, hail, and snow. Since such high voltage fuses usually comprise an arc quenching material such as boric acid or other such materials which if exposed to moisture will deteriorate thereby jeopardizing proper operation of the fuse, such high voltage fuses typically have been hermetically sealed to prevent the entrance of moisture to the interior thereof. Any sealing material used to seal such fuses must provide a moisture tight seal without degradation despite years of outdoor exposure.

Despite attempts to provide a reliable hermetically sealed fuse which will maintain its sealed relationship even after years of use, it has been discovered that rough handling, thermal expansion of various parts of the fuse formed from dissimilar materials, corrosion, and exposure to adverse weather conditions all contribute to cause small leaks to develop after a period of time despite the best attempts to totally and completely hermetically seal a fuse. Once even the smallest of leaks develops, a phenomenon called "pumping" results which causes the ingress of moisture into the interior of the fuse. Pumping results because of the well known physical relationship of pressure, volume, and temperature. Since the fuse has a constant interior volume, any change in the temperature of that volume correspondingly results in a change in the pressure in the interior of the fuse. Thus, when the temperature of the fuse drops rapidly, such as during a rainstorm, the interior pressure of the fuse tends to drop rapidly so that the interior pressure is less than the atmospheric pressure causing any moisture on the surface of the fuse to be sucked through any existing leaks around the various hermetic seals of the fuse. Once moisture is sucked into the fuse, it is retained in the fuse because there is no atmospheric venting to dry the interior of the fuse so that after a period of time there is a deterioration of the interior components of the fuse.

Accordingly, it has been discovered that it would be an advantageous advance in the art to provide a versatile, economical breather assembly for high voltage fuses which permits atmospheric venting to the interior of the fuse while precluding the admittance of moisture to the interior of the fuse regardless of the positional orientation of the fuse but which does not degrade the efficiency of the current interruption function of the fuse. The present invention is directed to such a breather assembly for a high voltage fuse and other electrical apparatus.

Breathers for switch operating mechanisms are known in the art as illustrated in U.S. Pat. No. 3,696,729 - Chabala, et al., but the fuse breather described and claimed herein is believed to be unique.

BRIEF DESCRIPTION OF THE INVENTION

The present invention relates to a breather assembly for atmospheric venting of the interior of electrical apparatus comprising a first chamber means communicating with the interior of the apparatus; a second chamber means communicating with the first chamber means; and a third chamber means communicating with the second chamber means and with the atmosphere in such a manner that moisture cannot flow directly in a straight line from the atmosphere to the first chamber irrespective of the positional orientation of the apparatus.

The first chamber means is formed by a first circular wall extending essentially perpendicularly from a base member which is mounted over an open end of the apparatus. The first chamber means communicates with the interior of the fuse through at least one opening through the base member. The second chamber means is formed between the first circular wall and a second circular wall extending essentially perpendicularly from the base member and surrounding the first circular wall. The second chamber means communicates with the first chamber means along the extending edge of the first circular wall. The third chamber means is formed between the second circular wall and a side wall of a cap member. The cap member comprises an end wall joined to the side wall which overlies and engages the extending edge of the second circular wall. The third chamber means communicates with the second chamber means through at least one opening through the second circular wall and communicates with the atmosphere through at least one opening through the side wall. The openings through the side wall are positioned away from the openings in the second circular wall so that moisture cannot flow directly in a straight line from the atmosphere to the first chamber means. Thus, moisture entering the opening in the side wall tends to collect in the third chamber, and if any moisture passes to the second chamber it tends to be collected in the second chamber so that it cannot enter the first chamber and the interior of the apparatus.

Thus, it is a principal object of the present invention to provide a breather assembly for a high voltage fuse that prevents water ingress to the interior of the high voltage fuse regardless of the positional orientation of the fuse while freely allowing the atmosphere to vent to the interior of the fuse.

Yet another object of the present invention is to provide a breather assembly for a high voltage fuse which allows the internal pressure of the fuse to rise and fall simultaneously with atmospheric pressure thus making seals less critical.

Yet another object of the present invention is to provide a breather assembly for a high voltage fuse which performs its desired function with equal efficiency with any positional orientation of the fuse.

Yet another object of the present invention is to provide a breather assembly for a high voltage fuse which enhances the operation of the fuse in interrupting current flow.

Yet another object of the present invention is to provide a breather assembly for a high voltage fuse which is economical but yet relatively rugged so that proper performance will not be affected by normal handling.

These and other objects, advantages and features will hereinafter appear, and for the purposes of illustration, but not for limitation, an exemplary embodiment of the present invention is illustrated in the accompanying drawings.

DETAILED DESCRIPTION OF THE PREFERRED EMBODIMENT

Figure 1:
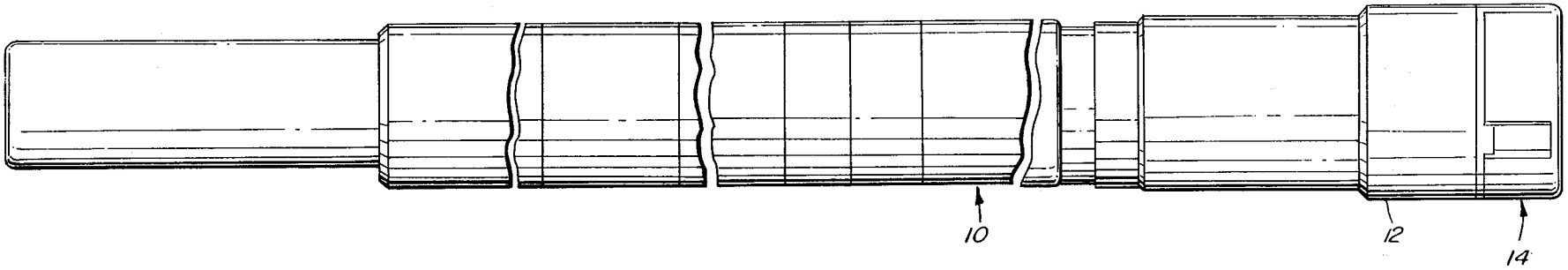
FIG. 1 is a side partially fragmentary view of a high voltage fuse having a preferred embodiment of the present invention mounted thereon.

With reference to FIG. 1, high voltage fuse 10 can take the form of any of a variety of well known high voltage interrupter fuses such as the fuse disclosed and described in U.S. Pat. No. 3,267,235 - Barta or the fuse disclosed in co-pending applications Ser. Nos. 740,930; 741,015; 741,026; 741,027; 741,028; all filed Nov. 11, 1976, assigned to the same assignee as the present invention. Fuse 10 comprises an exhaust ferrule 12 to which is mounted a breather assembly 14 in accordance with the present invention.

Figure 3:
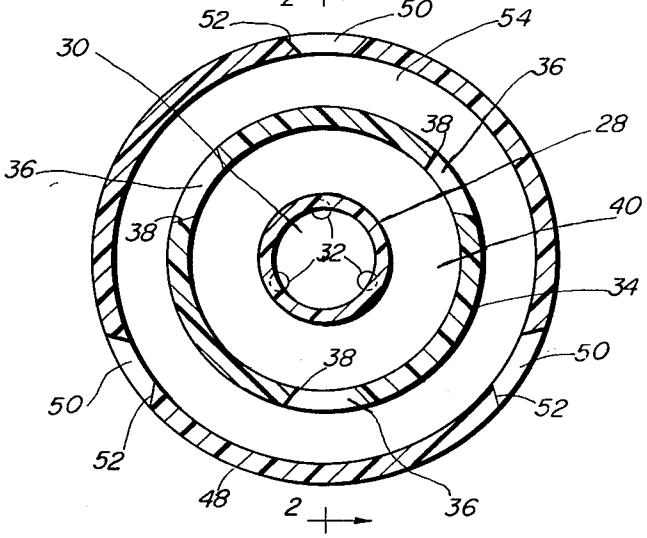
FIG. 3 is a cross-sectional view of the preferred embodiment taken substantially along line 3—3 in FIG. 2.
Figure 2:
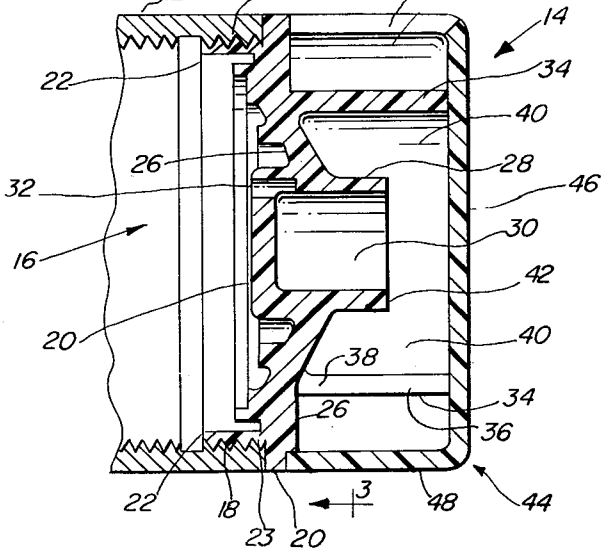
FIG. 2 is a side cross-sectional, partially fragmentary view of the preferred embodiment of the present invention.

With reference to FIGS. 2 and 3, ferrule 12 has a hollow interior 16 that communicates with the interior of fuse 10. Formed along the interior edge of ferrule 12 are threads 18 to which breather assembly 14 is threaded.

Breather assembly 14 comprises a base member 20 having an annular extending flange 22 upon which are formed threads 24 that mate with and engage threads 18 on ferrule 12. Annular flange 22 is joined to a base wall 26 of base member 20 which extends entirely across the open end of ferrule 12 along a narrowed or reduced section 23, the purpose of which will be more fully described below. Base wall 26 has a first circular wall 28 extending essentially perpendicularly therefrom so that a first chamber 30 is formed within first circular wall 28. Openings 32 are formed through base wall 26 and communicate between the interior of the fuse 10 and first chamber 30.

Also extending from base wall 26 is second circular wall 34 that surrounds the first circular wall 28. Formed through second circular wall 34 are openings 36 having chamfered edges 38 slanted in such a manner so as to increase the surface tension of any moisture forming along the edge of openings 36 to reduce the possibility that moisture will flow through the openings 36. A second chamber 40 is formed between the first and second circular walls 28 and 34. Second chamber 40 communicates with first chamber 30 along the circular extended edge 42 of first circular wall 28.

Positioned over base member 20 and mounted thereon is a cap member 44. Cap member 44 comprises an essentially flat circular end wall 46 and an annular side wall 48 joined along the peripheral edge of end wall 46 and extending essentially perpendicularly therefrom. Formed through side wall 48 are openings 50 having chamfered edges 52 slanted in such a manner that the surface tension of any moisture forming along the edge is increased to reduce the possibility that moisture will flow through the openings 50.

A third chamber 54 is formed between side wall 48 and second circular wall 34. Openings 50 allow communication of the atmosphere with the third chamber. The openings 50 are positioned in such a way that they are not directly aligned with openings 36 through the second circular wall 34. Thus, any moisture flowing through openings 50 cannot flow directly in a straight line through an opening 36 but must flow around and through third chamber 54 before approaching an opening 36.

It should be noted that the particular orientation of the walls and openings of breather assembly 14 substantially precludes the possibility that moisture will gain access to the interior of fuse 10 irrespective of the orientation of the fuse. With the fuse in a vertical position so that breather assembly 14 is positioned at the bottom of the fuse, it can be seen that while some moisture may flow through openings 50 and 36, since openings 32 in base wall 26 would be positioned well above such moisture, the moisture will not flow into the fuse. However, air will freely flow into the fuse through openings 32 thereby providing atmospheric venting to the interior portion of the fuse. If the fuse is oriented in a vertical position so that breather assembly 14 is at the top of the fuse, it can be seen that while moisture may flow through openings 50 and 36, it is very unlikely that sufficient moisture would collect in the second chamber 40 to the point where the moisture would flow over the extending edge 42 of first circular wall 28 and thereby gain access to the interior of the fuse 10 through openings 32. Correspondingly, if the fuse is positioned in a horizontal position (as illustrated in FIG. 1) moisture tending to flow through an opening 50 would tend to flow along the surfaces of third chamber 54. While some of the moisture might flow through an opening 36, that moisture would tend to flow along the interior surface of second circular wall 34 to the lowermost opening 36 and then flow back out of the second chamber 40. It would be highly unlikely that sufficient moisture would collect in second chamber 40 to enter first chamber 30 or openings 32. Thus, as can be seen, regardless of the positional orientation of the fuse 10, it is virtually impossible for moisture to form around or over any of the openings 32 so that it can be drawn into fuse 10. Accordingly, while the air can freely be drawn into the fuse as the pressure within the fuse changes due to temperature changes, moisture will not be drawn into the fuse since the moisture will not gain access to the openings 32.

To assure relatively low cost of breather assembly 14, it preferably is fabricated from plastic material and may be formed by injection molding. However, breather assembly 14 can also be formed of metallic material if desired.

It can be seen that breather assembly 14 allows the internal pressure of fuse 10 to rise and fall simultaneously with the atmospheric pressure thereby making the hermetic seals less critical while precluding the admittance of moisture into the interior of the fuse regardless of the physical orientation of the fuse. Further, since breather assembly 14 is typically formed of a relatively frangible material such as plastic, it does not hinder operation of the fuse since it will be blown off the end of the fuse along reduced section 23 when a high current is interrupted, and at low current interruption the breather 14 even tends to enhance fuse operations by allowing arc gas pressure to accelerate contact separation within the fuse. It has been found that restriction of venting during low current interruption and during the initial portion of high current interruption assists in the interruption process. However, free or unrestricted venting is essential to the interruption of high currents. Thus, reduced section 23 can be dimensioned to retain the breather assembly 14 over the end of the fuse until a predetermined pressure is developed whereupon reduced section 23 fractures so that the breather is expelled permitting free venting. In this manner, breather assembly 14 can enhance fuse operation.

It should be apparent to anyone reasonably skilled in the art that various changes, alterations, or modifications of the preferred embodiment illustrated herein can be made without departing from the spirit and scope of the present invention as defined in the appended claims.

We claim:

1. A breather assembly for permitting atmospheric venting to the interior of electrical apparatus comprising:

a first chamber means for communicating with the interior of the apparatus;

a second chamber means for communicating with said first chamber means;

a third chamber means for communicating with said second chamber means and with the atmosphere in such a manner that moisture cannot flow directly in a straight line from the atmosphere to said first chamber irrespective of the positional orientation of the apparatus whereby moisture is prevented from entering the apparatus but the atmosphere is freely vented thereto.

2. A breather assembly, as claimed in claim 1, wherein:

said first chamber means is defined by a first continuous wall extending from a base member mounted over an open end of the apparatus and said first chamber means communicates with the interior of the apparatus through at least one opening through said base member;

said second chamber means is defined between said first continuous wall and a second continuous wall extending from said base member and surrounding said first continuous wall, said second chamber means communicating with said first chamber means along an extending edge of said first continuous wall; and said third chamber means is defined between said second continuous wall and a circular side wall of a cap member, said cap member having a flat end wall joined to said side wall and overlying and engaging the extending edge of said second continuous wall, said side wall extending to and joined with said base member, said third chamber means communicating with said second chamber means through at least one opening through said second continuous wall, and said third chamber means communicating with the atmosphere through at least one opening through said side wall, said opening through said side wall being positioned away from the opening in said second continuous wall so that moisture cannot flow directly in a straight line from the atmosphere to said first chamber means whereby moisture is precluded from entering the base but the atmosphere is freely vented thereto.

3. A breather assembly, as claimed in claim 2, wherein said at least one opening in said second continuous wall and said at least one opening in said side wall have chamfered edges to increase the surface tension of moisture forming along said edges.

4. A breather assembly for atmospheric venting to the interior of a high voltage fuse comprising:

a base member mounted over an open end of the fuse, said base member having at least one opening therethrough communicating with the interior of the fuse;

first wall means extending from said base member and surrounding said opening;

second wall means extending from said base member and surrounding said first wall means, said second wall means having openings therethrough;

a cap means overlying said base member including an end wall and a side wall joined to the end wall, said side wall connected to said base member so that an interior surface of said end wall engages the extending edge of said second wall means but not the edge of said first wall means, said side wall having openings therethrough aligned at a position away from said openings in said second wall means so that moisture cannot flow in a straight line directly through said openings in said side wall and said second wall means to said opening in said base member whereby moisture is prevented from entering the fuse but the atmosphere is freely vented thereto.

5. A breather assembly, as claimed in claim 4, wherein said base member is mounted over the open end of the fuse by a reduced member on said base member, said reduced member dimensioned to retain said breather assembly over said open end of the fuse for restricted venting during fuse operation until a predetermined pressure is developed whereupon said reduced member separates from said base member to allow said breather assembly to be expelled so that free venting occurs.

6. A breather assembly for atmospheric venting of the interior of a high voltage fuse comprising:

a base member having threads formed thereon for being screwed onto threads in an open end of the fuse to attach said base member to the fuse, said base member having at least one opening centrally located therethrough for communicating with the interior of the fuse, said base member having a first circular wall extending essentially perpendicularly therefrom positioned around said at least one opening, and having a second circular wall extending essentially perpendicularly therefrom and positioned away from and around said first circular wall, said second circular wall having at least one opening therethrough;

a cap member having a flat circular end wall and a curved side wall joined to the peripheral edge of said end wall and extending essentially perpendicularly therefrom, said cap member overlying said base member and said first and second circular walls so that the extending edge of said second circular wall engages an interior surface of said end wall but leaves a gap between the interior surface of said end wall and the extending edge of said first circular wall, said side wall having at least one opening therefrom positioned away from said at least one opening in said second circular wall so that moisture cannot flow directly in a straight line through said openings in said side wall and said second circular wall to said at least one opening in said base member whereby moisture is prevented from entering the fuse but the atmosphere is freely vented thereto.

7. A breather assembly, as claimed in claim 6, wherein said openings in said second circular wall and said side wall have chamfered edges to increase the surface tension of moisture forming along said edges.

8. A breather assembly, as claimed in claim 6, wherein said threads on said base member are joined to said base member along a reduced section of said base member, said reduced section dimensioned to retain said breather assembly over the open end of the fuse for reduced venting during fuse operation until a predetermined pressure is developed whereupon said reduced section fractures allowing said breather assembly to be expelled so that free venting occurs.

9. In a circuit interrupter including a high voltage fuse having an interior space, and an exhaust ferrule mounted at one end; an improved breather assembly comprising:

a base member connected to and substantially closing an open end of the exhaust ferrule, said base member having a vent opening to permit limited flow of gas therethrough, a body sealingly joined to said base member to define an enclosed hollow space, said body having openings therethrough constituting passages between said hollow space and the exterior of said breather assembly, said passages providing communicating channels between said vent opening and the exterior of said breather assembly that prevent moisture from gaining access to said vent openings, said breather assembly normally providing for limited gas flow between said interior space and the ambient atmosphere during fuse operation but which may be expelled from said exhaust ferrule when circuit interruption produces a predetermined gas pressure, thereby substantially opening said exhaust ferrule.

10. In a circuit interrupter including a high voltage fuse having an interior space, and an exhaust ferrule mounted at one end; an improved breather assembly comprising:

a base member connected to and substantially closing an open end of the exhaust ferrule, said base member having a vent opening to permit limited flow of gas therethrough, said base member further having a reduced section adjacent said exhaust ferrule, a body sealingly joined to said base member to define an enclosed hollow space, said body having openings therethrough constituting passages between said hollow space and the exterior of said breather assembly, said passages providing communicating channels between said vent opening and the exterior of said breather assembly but which prevent moisture from gaining access to said vent opening, said breather assembly normally providing for limited gas flow between said interior space and the ambient atmosphere during fuse operation, but said reduced section being fracturable allowing said breather assembly to be expelled from said exhaust ferrule when circuit interruption produces a predetermined gas pressure, thereby substantially opening said exhaust ferrule.

* * * * *